United States Patent [19]

Chien

[11] Patent Number: 4,646,732

[45] Date of Patent: Mar. 3, 1987

[54] CIRCULATIVE RESPIRATORY MASK

[76] Inventor: Chao-Huei Chien, P.O. Box 10160, Taipei, Taiwan

[21] Appl. No.: 769,474

[22] Filed: Aug. 26, 1985

[51] Int. Cl.[4] ..... A62B 7/00

[52] U.S. Cl. ..... 128/205.12; 128/206.15

[58] Field of Search ..... 128/201.25, 201.29, 128/205.25, 205.12, 204.21, 206.15, 206.17

[56] References Cited

U.S. PATENT DOCUMENTS 4,320,755 3/1982 Flint et al. ..... 128/205.12
4,478,216 10/1984 Dukowski ..... 128/285.12
4,502,480 3/1985 Yamamoto ..... 128/205.12

FOREIGN PATENT DOCUMENTS 2032284 5/1980 United Kingdom ..... 128/201.25

*Primary Examiner*—Henry J. Recla

[57] ABSTRACT

A circulative respiratory mask including a mask portion adapted for wearer's mouth and nose, a casing connected with the mask portion for fixing a driving motor, a pair of supplying air fans and a pair of exhausting air therein, and a pair of canisters respectively formed on both sides of the casing so that the air can be effectively circulated by the fans for comfortable breathing of the wearer.

1 Claim, 1 Drawing Figure

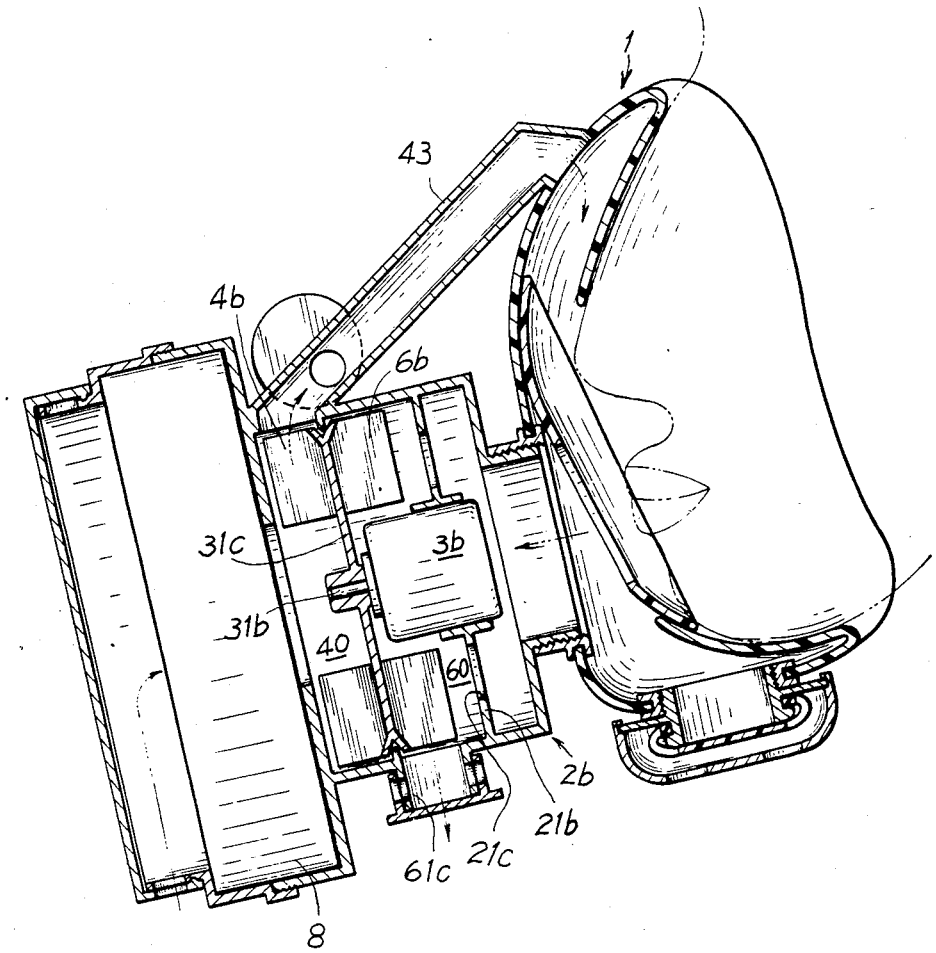
1
43
4b
6b
31c
3b
31b
40
60
2b
21b
21c
61c
8

CIRCULATIVE RESPIRATORY MASK

BACKGROUND OF THE INVENTION

U.S. patent application of Ser. No. 516,687 filed on July 25, 1983 now U.S. Pat. No. 4,549,542 by the same applicant discloses a multiple-effect respirator comprising a driving motor, a supplying air fan, an exhausting air fan, two ventilating air fans and a mask wherein all the fans are mounted on a helmet and commonly driven by the single motor so that the driving force of the motor is only partially distributed to supplying air fan and exhausting air fan for circulating the air for wearer's breathing as partial driving force of the motor is shared by the two ventilating fans directing air into wearer's helmet to thereby greatly reduce the forced circulation effect within the mask.

The present inventor has found this defect and invented the present respiratory mask.

SUMMARY OF THE INVENTION

The object of the present invention is to provide a respiratory mask including a mask portion adapted for wearer's mouth and nose, a central casing, a driving motor, a pair of supplying air fans, a pair of exhausting air fans and a pair of canisters disposed on both sides on the casing wherein the air may be filtered through both canisters and circulated by the fans to perform a forced circulation of air for comfortable breathing of the mask wearer.

BRIEF DESCRIPTION OF THE DRAWING

The FIGURE is a sectional illustration of the present invention.

DETAILED DESCRIPTION

The present invention as shown in the FIGURE comprises: a mask portion 1 adapted for wearer's mouth and nose, a casing **2*b* connected with the mask portion 1, a driving motor 3*b* mounted on a partition plate 21*b* formed in the casing 2*b* and having holes 21*c* formed on the plate 21*b* to fluidically communicate with a discharge chamber 60 and the mask portion 1, a supplying air fan 4*b* formed on an outer side of a rotating disk 31*c* for operatively sucking the incoming air through a canister 8 formed on the outer end of the casing 2*b* in front of a suction chamber 40, and an exhausting air fan 6*b* formed on an inner side of the rotating disk 31*c* opposite to said fan 4*b* for operatively sucking exhaled air from the mask portion 1**.

The rotating disk **31*c* has its central portion axially fixed on a motor shaft 31*b* protruding outwardly from the discharge chamber 60 of the motor 3*b*. A suction chamber 40 is defined among the canister 8, the rotating disk 31*c* having the supplying air fan 4*b* formed thereon, and the casing 2*b*. The discharge chamber 60 is defined among the rotating disk 31*c* having the exhausting air fan 6*b* formed thereon, the partition plate 21*b* and the casing 2*b***.

A delivery tube 43 is fluidically communicated with the suction chamber 40 and the mask portion 1. An exhausting vent **61*c* formed on the lower portion of casing 2*b* is fluidically communicated with the discharge chamber 60 to discharge the exhaled air as sucked by the exhausting air fan 6*b* through the holes 21*c*. The partition plate 21*b* is positioned between the discharge chamber 60 and the mask portion 1**.

Upon the driving of the motor **2*b*, an air stream will be sucked by said supplying fan 4*b* through the canister 8, the suction chamber 40, the delivery tube 43 to the mask portion 1 for wearer's inhaling and the exhaled air in mask portion 1 will be sucked by the exhausting fan 6*b* through the holes 21*c* on partition plate 21*b* and finally discharged through the vent 61*c***.

In order to dampen the possible back pressure developed in discharge chamber, a back-pressure damper having a central hole is fixed on the lower edge of said mask portion 1.

I claim:

1. A circulative respiratory mask comprising: a mask portion adapted to fit over a wearer's mouth and nose and having an inlet opening and an outlet opening; a casing having one end connected to said outlet opening of said mask portion and having a partition plate therein between said one end and an opposite end; a driving motor having a rotating shaft mounted on a partition plate formed in said casing and positioned between said outlet opening of said mask portion and said opposite end, a rotating disk having its center mounted on said motor shaft between said partition plate and said opposite end and having a supplying air fan formed on an outer side of said disk facing said one end of said casing and having an exhausting air fan formed on an inner side of said disk facing said partition plate, said partition plate with said motor and said casing defining the boundaries of a discharge chamber; said partition plate having holes formed therethrough to fluidically communicate with said discharge chamber, and said outlet opening of said mask portion;

said rotating disk with said outer end of said casing defining the boundaries of a suction chamber;

said exhausting air fan formed on an inner side of said rotating disk opposite to said supplying air fan;

a filter canister formed on the outer end of said casing in front of said suction chamber and fluidically connected therewith; a delivery tube fluidically connected between said suction chamber and said mask portion inlet opening; and an exhausting vent formed on the lower portion of said casing and fluidically connected to said discharge chamber, whereby upon driving of said motor, an air stream is sucked by said supplying air fan through said canister, said suction chamber, and said delivery tube towards said mask portion for a wearer's inhaling and the exhaled air in said mask portion is sucked by said exhausting air fan through said holes formed on said partition plate and discharged through said exhausting vent.

* * * * *